US010479652B2

(12) United States Patent
Evans et al.

(10) Patent No.: US 10,479,652 B2
(45) Date of Patent: Nov. 19, 2019

(54) LATERAL DAMPING AND INTERMEDIATE SUPPORT FOR ESCALATORS AND MOVING WALKS IN SEISMIC EVENTS

(71) Applicant: Inventio AG, Hergiswil (CH)

(72) Inventors: David Evans, Clayton, NC (US); David Krampl, Vienna (AT); Michael Matheisl, Vosendorf (AT)

(73) Assignee: INVENTIO AG, Hergiswil (CH)

( * ) Notice: Subject to any disclaimer, the term of this patent is extended or adjusted under 35 U.S.C. 154(b) by 484 days.

(21) Appl. No.: 15/129,951

(22) PCT Filed: Mar. 26, 2015

(86) PCT No.: PCT/US2015/022661

§ 371 (c)(1),
(2) Date: Sep. 28, 2016

(87) PCT Pub. No.: WO2015/148762

PCT Pub. Date: Oct. 1, 2015

(65) Prior Publication Data

US 2017/0174475 A1 Jun. 22, 2017

Related U.S. Application Data

(60) Provisional application No. 61/971,805, filed on Mar. 28, 2014.

(51) Int. Cl.
*B66B 23/00* (2006.01)
*E04H 9/02* (2006.01)

(52) U.S. Cl.
CPC ..... *B66B 23/00* (2013.01); *E04H 9/021* (2013.01)

(58) Field of Classification Search
CPC ..... B66B 23/00; B66B 5/022; B66B 21/02; B66B 21/10; E04H 9/02; E04H 9/021; E04H 9/024; F16F 7/08; F16M 11/20; F16M 11/2085; F16M 2200/08; F16M 11/22
USPC ..... 248/569, 188.1, 354.3; 198/321, 326; 52/167.4, 167.1, 167.6–167.8, 299, 126.6; 384/36; 403/DIG. 15, 167, 61
See application file for complete search history.

(56) References Cited

U.S. PATENT DOCUMENTS 2,664,990 A 1/1954 Georgiev et al.
2,968,458 A * 1/1961 Moeller ..... B63G 9/00 114/76
3,368,496 A 2/1968 Falk et al.
(Continued)

FOREIGN PATENT DOCUMENTS

CN 1715170 A 1/2006
CN 201545587 U 8/2010
(Continued)

OTHER PUBLICATIONS

Machine Translation for Applicant cited JP 2011-63389 to Mitsubishi (Year: 2011).*

*Primary Examiner* — Ingrid M Weinhold
(74) *Attorney, Agent, or Firm* — William J. Clemens; Shumaker, Loop & Kendrick, LLP

(57) ABSTRACT

An intermediate support structure for an escalator or moving walk having a dampening device with slots formed therein allowing a supported escalator truss to be free to move laterally to accommodate lateral displacement caused by story drift during an earthquake or seismic event.

15 Claims, 4 Drawing Sheets

(56) References Cited

U.S. PATENT DOCUMENTS 3,830,024 A * 8/1974 Warnke ..... E04B 1/34347 52/126.7
4,413,719 A 11/1983 White
4,519,490 A 5/1985 White
4,546,582 A * 10/1985 Gartner ..... E04H 9/02 52/235
4,553,792 A * 11/1985 Reeve ..... E04B 1/36 384/26
4,599,834 A * 7/1986 Fujimoto ..... E02D 27/34 376/285
4,662,133 A * 5/1987 Kondo ..... E04H 9/021 248/567
4,684,097 A * 8/1987 Cox ..... E04B 1/34336 248/354.3
4,738,061 A * 4/1988 Herndon ..... E02D 27/02 52/126.6
4,917,211 A * 4/1990 Yamada ..... E04H 9/023 181/0.5
5,363,610 A * 11/1994 Thomas ..... E04B 1/34347 52/126.6
5,456,047 A * 10/1995 Dorka ..... E04H 9/021 248/568
D366,944 S * 2/1996 Maxwell ..... D25/138
5,595,366 A * 1/1997 Cusimano ..... E02D 27/34 248/354.3
5,816,559 A * 10/1998 Fujimoto ..... E04H 9/021 248/636
5,862,635 A * 1/1999 Linse ..... E04H 9/14 52/126.6
5,870,866 A * 2/1999 Herndon ..... E02D 27/48 52/126.6
5,873,679 A * 2/1999 Cusimano ..... E02D 27/48 405/229
5,906,080 A * 5/1999 diGirolamo ..... E04B 2/7453 411/546
6,094,873 A * 8/2000 Hoffman ..... E02D 27/01 52/126.6
6,129,198 A 10/2000 Nusime
6,354,047 B1 * 3/2002 Shimoda ..... E01D 19/02 52/167.1
6,637,580 B1 10/2003 Sneed
6,840,017 B1 * 1/2005 Shimoda ..... E04H 9/02 52/1
7,077,250 B2 * 7/2006 Folkens ..... F16F 9/16 188/380
7,472,518 B2 * 1/2009 Tsai ..... E04H 9/023 248/562
7,797,886 B2 * 9/2010 Su ..... E04H 9/02 248/632
8,511,032 B2 * 8/2013 Abdel-Rahman ..... E04B 2/88 248/228.1
9,316,279 B2 * 4/2016 Meisel ..... E04H 9/021
2002/0062617 A1 * 5/2002 diGirolamo ..... E04B 2/767 52/688
2002/0078638 A1 * 6/2002 Huang ..... E04B 5/10 52/126.6
2003/0102198 A1 * 6/2003 Nusime ..... B66B 21/00 198/321
2006/0144006 A1 * 7/2006 Suzuki ..... E04B 1/2403 52/655.1
2009/0223146 A1 * 9/2009 Platt ..... E04B 9/08 52/167.8
2012/0138402 A1 * 6/2012 Choi ..... E04H 9/02 188/381
2014/0191104 A1 * 7/2014 Meisel ..... E04H 9/021 248/624
2015/0204097 A1 * 7/2015 Chou ..... E04H 9/14 52/167.1

FOREIGN PATENT DOCUMENTS

JP S5855128 U 4/1983
JP H0761753 A 3/1995
JP H10194646 A 7/1998
JP 2000095471 A 4/2000
JP 2003267655 A 9/2003
JP 2009107760 A 5/2009
JP 2011063389 A 3/2011
JP 2011063390 A 3/2011
JP 2013245084 A 12/2013

* cited by examiner

LATERAL DAMPING AND INTERMEDIATE SUPPORT FOR ESCALATORS AND MOVING WALKS IN SEISMIC EVENTS

FIELD

The present disclosure relates generally to the field of escalators and moving walks, and more particularly to a connection device and structure that provides both lateral damping and intermediate support to an escalator or moving walks when such an escalator or moving walk is subjected to displacement, and in particular, to "story drift" displacement caused by a seismic event or earthquake.

BACKGROUND

Prior art moving walks or escalators typically include a support truss and a plurality of interconnected steps or flat links that travel in a loop within the truss to provide a continuous movement along a specified path. When the escalator or moving walk assembly is appropriately mounted between the floors of a building, relative motion exists between the moving steps and the stationary structure of the conveyor system. If the escalator or moving walk assembly is rigidly mounted between the adjacent floors of a building, or between two separate buildings or structures, and no provision is made for relative movement between the escalator or moving walk assembly and the building structure, failures can occur during earthquakes or seismic events.

For this reason various states, including California, have adopted specific seismic requirements for escalators and moving walks. Such statutes have often included requirements with respect to movement relative to a single floor ("lateral drift"), but more recently have become more focused on interfloor movement ("story drift"). In this regard, California Code has recently been amended to take into account potential story drift events, and specifically, the use of intermediate supports in connection therewith (see California Code Sec. 3137 (d)(2)(C)—"Seismic restraint shall be provided in the transverse direction at all supports. Intermediate supports, if any, shall be free to move laterally in all directions.").

In order to address such circumstances, there have been a multitude of prior art escalator and/or moving walk designs that have been designed to accommodate aspects of story drift that may occurs during seismic events. For example, U.S. Pat. No. 6,129,198 to Nusime discloses an escalator assembly having a bed support which is in turn supported upon a bed formed as part of the building construction by a resilient mounting element which provides damping for vibration and the like passing between the escalator and the building construction. A second end of the carrier is similarly provided with a bed support which is supported upon a fulcrum firmly mounted to the bed. The fulcrum may be in the form of a screw upon which the bed support is detented and damping means may be incorporated into the fulcrum construction.

Conversely, U.S. Pat. No. 6,637,580 to Sneed discloses a telescoping assembly for an escalator mount that allows movement of the escalator relative to the portions of the building in which it is mounted in a longitudinal direction. Further, the center portion of the mount includes a sill plate that is mounted on a pivot to allow for story drift-type movement.

While all of the foregoing disclosed, and other, prior art structures may have utility in addressing issues with story drift in escalators and moving walks during seismic events, it is still desired to have an escalator or moving walk support structure that provides adequate desired intermediate support for the escalator or moving walk, is relatively simple in design and cost effective in implementation, and which effectively accommodates "story drift" movement that may occur during earthquakes or other seismic events.

SUMMARY

The present disclosure is directed to an intermediate support structure for an escalator or moving walk that allows at least some amount of free lateral movement of the escalator truss or moving walk truss in all directions during an earthquake or a seismic event. The movement in the horizontal directions is particularly necessary to allow some amount of free lateral movement to prevent significant damages when building story drift occurs.

More specifically, the present disclosure discloses the use of a dampening device, in connection with an intermediate support having slots therein, that allow the supported escalator or moving walk truss to be free to move laterally in all directions to accommodate lateral displacement of the upper support due to story drift while simultaneously controlling lateral deflection and oscillation along the length of the truss. The structure according to the present disclosure thus allows for desired movement while simultaneously preventing excessive stress level in the truss members.

More specifically, the present disclosure provides an escalator or moving walk support structure including a truss support having lateral slots therein, an intermediate vertical member having a first end and a second end, wherein the intermediate vertical member is connected to the truss support through the slots and to the building support at the second end, such that once a predetermined coefficient of friction is overcome, the intermediate vertical member is free to move laterally with respect to the truss support.

In accordance with the foregoing, the intermediate vertical member may be connected to the building support between two resilient buffers and/or the second end of the intermediate vertical member may be connected to the building support between two angle brackets. The intermediate vertical support may include a foot attached that is connected to a first sliding plate by connection screws extending through the sliding plate and the lateral slots.

The escalator or moving walk support structure may also include side posts arranged at each lateral end of the truss support so that the side posts bear vertical forces acting on the support structure, and further includes plate bearings below the side posts to allow lateral movement of the side posts relative to the building support. The support structure may also include a second sliding plate and the truss support may comprise an "I" beam. Additionally, the truss support may include a first fixed plate on a bottom side of the bottom portion of the truss support and a second fixed plate on a top side of a bottom portion of the truss support such that the first sliding plate is attached to the first fixed plate and the second sliding plate is attached to the second fixed plate.

In accordance with the disclosure, the first and second sliding plates of the escalator or moving walk support may be connected by connection screws, they may be screwed to a tightening torque of between about 40 Nm and 80 Nm, and they may be made of any suitable materials, including, but not limited to stainless steel, brass, copper, PTFE coated sheet materials, or white metal. The first and second sliding plates and the first and second fixed plates form a slip joint connection wherein the term "sliding plate" is defined and used herein as a plate having a surface upon which another plate slides.

In an alternate embodiment of the disclosure, the escalator or moving walk support structure may include a truss support, an intermediate vertical member having a first end and a second end, wherein the first end is attached to the truss support and the second end is connected to at least one mounting bracket, the mounting bracket having at least one slot therein for receiving at least one connection screw for connecting the mounting bracket to a building support, a joint plate positioned between the mounting bracket and the building support, wherein the connection screw is connected to the building support such that once a predetermined coefficient of friction is overcome, the intermediate vertical member is free to move laterally with respect to the bracket.

DETAILED DESCRIPTION

There has thus been outlined, rather broadly, certain aspects of the disclosure in order that the detailed description thereof herein may be better understood, and in order that the present contribution to the art may be better appreciated. There are, of course, additional aspects of the disclosure that will be described below and which will form the subject matter of the claims appended hereto.

Figure 1:
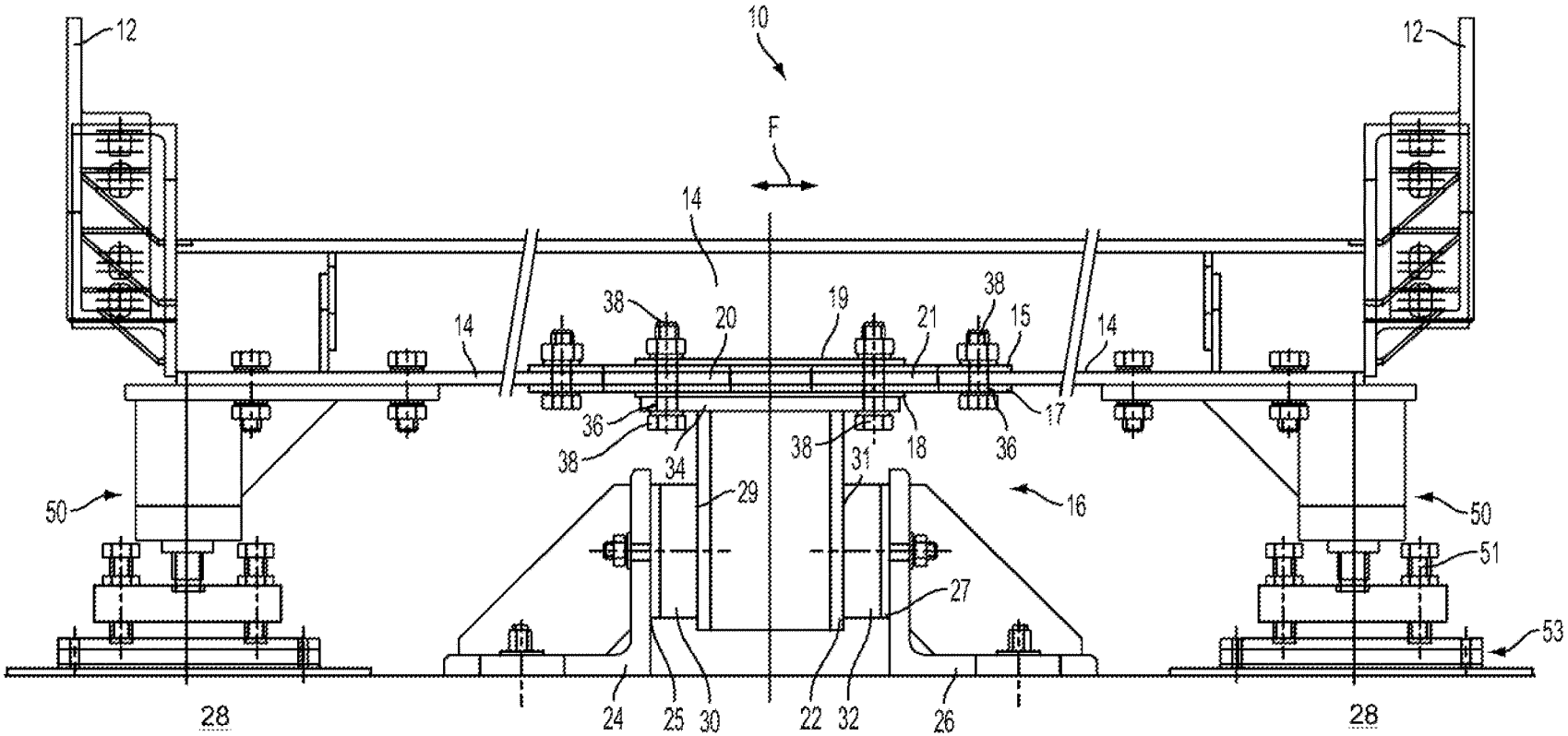
FIG. 1 depicts a front elevation view of an intermediate mounting structure for an escalator or moving walk assembly according to an aspect of the disclosure.
Figure 3:
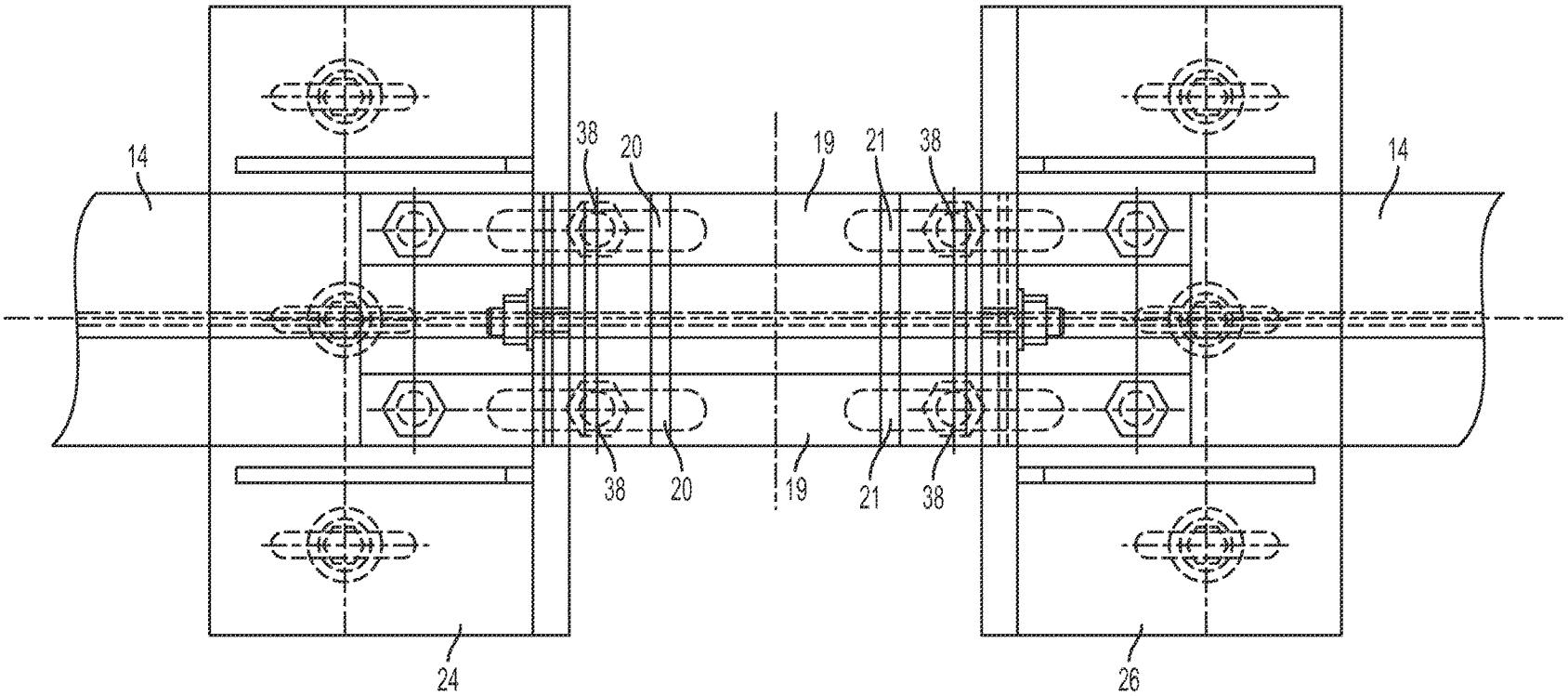
FIG. 3 depicts a top plan view of the intermediate mounting structure of FIG. 1.

As shown best in FIGS. 1 and 3, the present disclosure is directed to a support structure 10 for an escalator or moving walk 12 that allows at least some amount of free lateral movement of the truss support 14 in all directions during an earthquake or a seismic event. More specifically, the present disclosure discloses the use of a dampening device 16, in connection with the truss support 14, including a vertical member 22. As is known in the art, the truss support 14 may be an "I" beam structure and may include the upper 15 and lower 17 fixed plates. The truss support 14 and the fixed plates 15, 17 are provided with slots 20, 21 therein that allow the supported truss support 14 to be free to move laterally to accommodate lateral displacement of the escalator or moving walk 12 upper support (not shown) due to story drift while simultaneously controlling lateral deflection and oscillation along the length of the escalator or moving walk 12. The support structure 10 according to the present disclosure thus allows for desired movement while simultaneously preventing excessive stress level in the truss members (not shown).

More specifically, the intermediate support vertical member 22, which may be an "I" beam structure, may be attached to the underside of the truss support 14. The lower portion of the dampening device 16 may be constructed to "trap" the vertical member 22 between two angle brackets 24, 26 mounted to the building support 28. Resilient buffers 30, 32, which may be made from any desired material such as rubber, may be attached to each of the faces 25, 27 of the angle brackets 24, 26 adjacent to the vertical faces 29, 31 of the vertical member 22. Vertical member 22 preferably includes a foot 34, which may be attached to the truss support 14 through at least one sliding plate 18 which forms one portion of the slip joint connection. In accordance with an embodiment hereof, at least a second sliding plate 19 or low friction washer may be positioned on an opposite side of the truss support 14 to comprise a second portion of the slip joint connection. The sliding plates 18, 19 may be made of any suitable material including stainless steel, brass, copper, PTFE coated sheet materials, white metal, and/or other suitable materials.

Vertical forces of the escalator or moving walk 12 are supported by side posts 50 which are arranged at each side of the truss support 14. The height of the side posts 50 is adjustable by adjustment screws 51. To allow free lateral movement of the side posts 50 relative to the building support 28, the side posts 50 may comprise plate bearings 53. As shown in the present example, the adjustment screws 51 can move together with the side posts 50.

Figure 2:
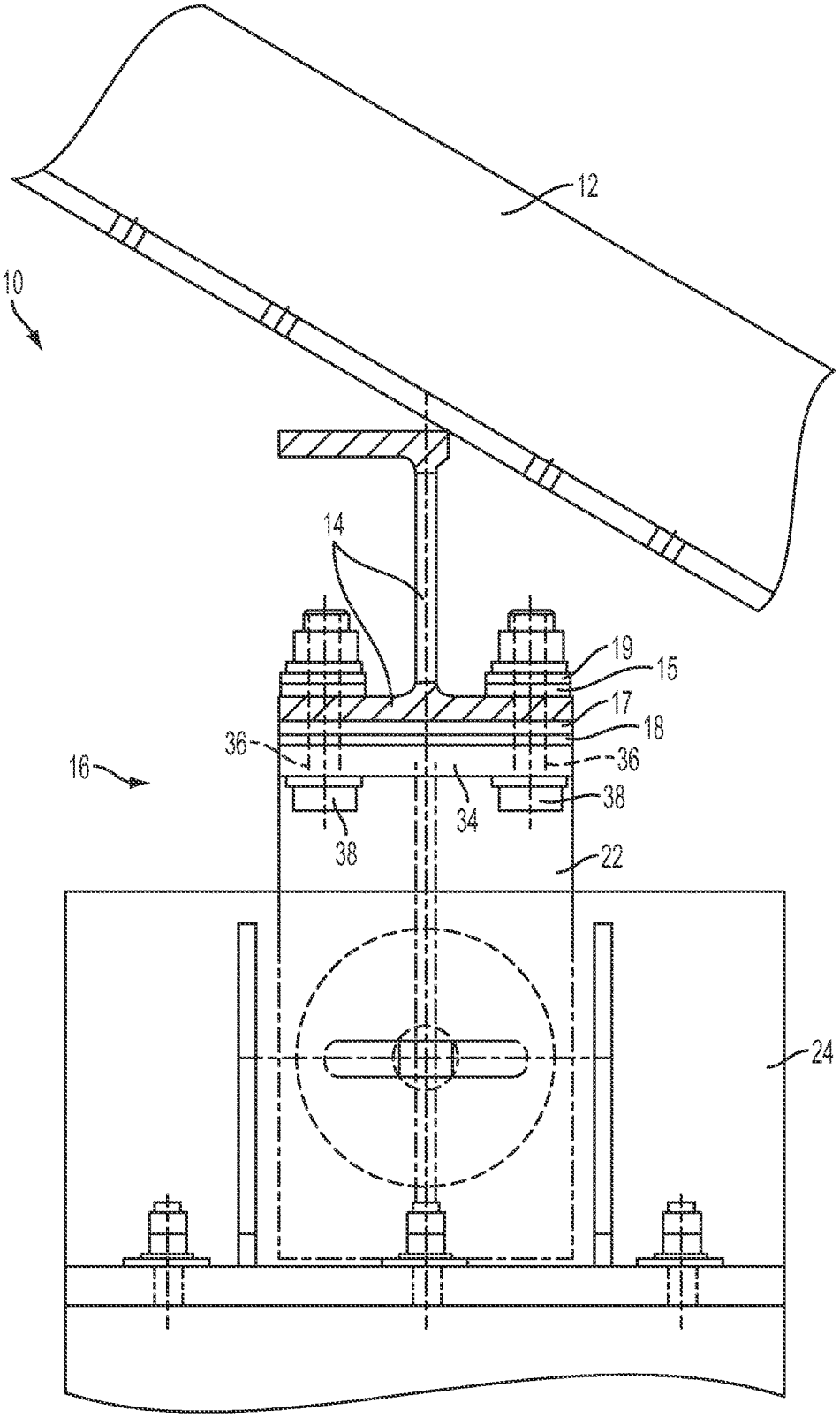
FIG. 2 depicts a side elevation view of the intermediate mounting structure of FIG. 1.

The foot 34 of the vertical member 22 and the sliding plates 18, 19 may have four clearance holes 36 for receiving the connecting screws 38. As best shown in FIGS. 1-3, the truss support 14 and the fixed plates 17, 15 have the slots 20, 21 running in the lateral direction to allow for the desired lateral movement. Thus, in accordance with an embodiment hereof, the connecting screws 38 may be received through the holes 36 and then may extend through the sliding plate 18, the slots 20, 21 in the fixed plate 17, the truss support 14, and the fixed plate 15, and then finally through the holes 36 in the sliding plate 19 to make the desired connection. The connecting screws 38 may be installed with a setting torque in order to provide a specifically calculated and desired clamping force between the sliding plates 18 and 19 and the corresponding fixed plates 17 and 15.

More specifically, the torque of the connecting screws 38 may be set so that the oscillation and lateral deflection along the length of truss support 14 during a seismic event is properly controlled. In accordance herewith, the escalator or moving walk 12 may be buffered from some undesirable oscillation during a seismic event or earthquake. Conversely, in the case of story drift, the slip joint connection comprised of the sliding plates 18, 19 and the fixed plates 17, 15 becomes flexible, due to overcoming friction between the respective plates, thus allowing desired lateral movement of the truss support 14.

In accordance with the disclosure, the connection of the vertical member 22 and the truss support 14 must be set so that the slip joint connection can accommodate lateral movement for story drift while also dampening oscillation throughout the truss (not shown) in a seismic event. This requirement may be achieved by pre-loading the connecting screws 38 (which may be standard M20 fasteners as is known in the art) used for connecting the sliding plates 18, 19 and the fixed plates 17, 15 to produce the desired friction therebetween. In practice, it may be desirable to use stainless steel for the sliding plates 18, 19 to help prevent corrosion which may detrimentally effect the coefficient of friction between the sliding plates 18, 19 and the fixed plates 17, 15.

For purposes of explanation, the transmitted horizontal force (F) from the truss support 14 beam to the resilient buffers 30, 32 may be assumed to be approximately 31 kN. Using the standard expression $F=u*N$ to calculate the pre-load force (N) required in each of the connecting screws 38, and modifying it appropriately to take into account that the slip joint connection may be comprised of 2 separate sliding connections between the respective sliding plates 18, 19 and the fixed plates 17, 15, the expression may be modified to: F=u*N*s where s =number of sliding connections. The coefficient of friction (u) for steel against steel between the faces of the stainless steel plates may be assumed to be approximately 0.2. The normal force N per screw may thus be calculated as N=F/(4*s*u), in this case, therefore N=31 kN/4×0.21×2=18.45 kN. According to this, in one embodiment of the disclosure, this force may be used as the required pre-load in each connecting screw 38. It should be noted, however, that to determine the values above, friction forces occurring between the plate bearings 53 and the side posts 50 are not taken into account.

In accordance with one embodiment of the disclosure, the connecting screws 38 may be M20 standard metric fasteners with grade 8.8. For this screw size and grade the following data is assumed to be valid: maximum pre-load =117000 N; maximum tightening torque =390 Nm. Accordingly, assuming such parameters, the pre-load per Nm torque may be calculated as follows 117000 N/390 Nm =300 N/Nm. In accordance therewith, the tightening torque setting required per connecting screw 38 may be calculated as 18450 N/300 N/Nm =61.5 Nm.

Figure 4:
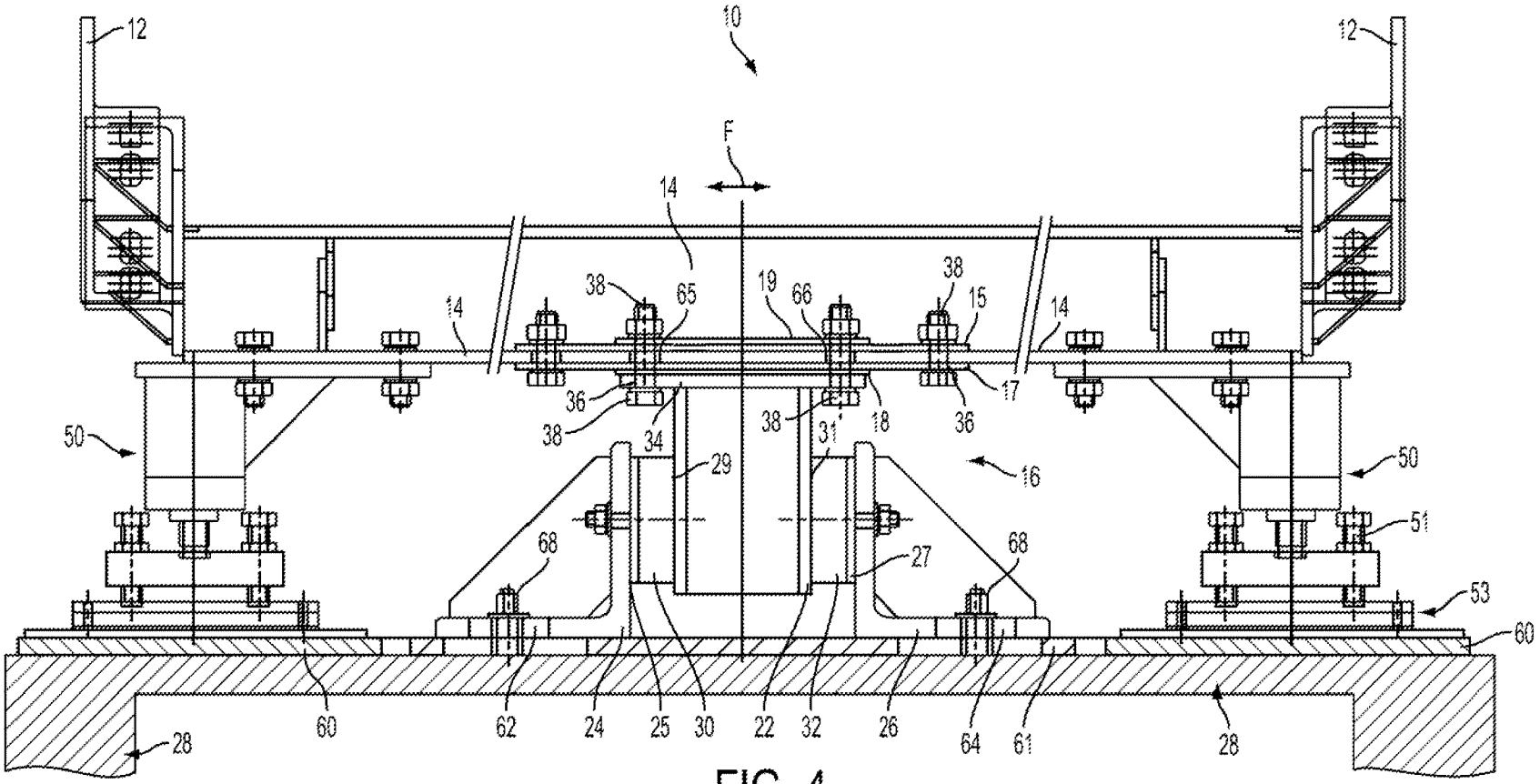
FIG. 4 depicts a front elevation view of a further embodiment of an intermediate mounting structure in accordance with the disclosure.

As shown best in FIG. 4, an alternate embodiment of the present disclosure may incorporate sheet plates 60 and a joint plate 61 to accommodate potential story drift as discussed above. In accordance with this embodiment, lateral movement may be accommodated between the truss support 14 and the building support 28 by slots 62, 64 formed in the brackets 24, 26. In accordance therewith, the slots 20, 21 in the fixed plates 15, 17 are replaced with corresponding holes 65, 66 thereby preventing lateral movement of the truss support 14 with respect to the angle brackets 24, 26. Instead, as will be readily understood by those of ordinary skill in the art, the lateral movement is allowed between the angle brackets 24, 26 and the joint plate 61 through the use of the slots 62, 64. Further in accordance with this embodiment, low torque bolts 68 may be used to secure the angle brackets 24, 26 to the building support 28 through the joint plate 61. In order to facilitate such desired movement during seismic events, as well as to prevent corrosion of friction surfaces, lubrication may be provided between the joint plate 61 and the angle brackets 24, 26.

The many features and advantages of the disclosure are apparent from the detailed specification, and, thus, it is intended by the appended claims to cover all such features and advantages of the disclosure which fall within the true spirit and scope of the disclosure. For example, all surfaces of sliding plates may be lubricated with oil or grease to reduce the friction coefficient between the friction members and to prevent corrosion of the friction surfaces. Further, since numerous modifications and variations will readily occur to those skilled in the art, it is not desired to limit the disclosure to the exact construction and operation illustrated and described, and, accordingly, all suitable modifications and equivalents may be resorted to that fall within the scope of the disclosure.

What is claimed is:

1. A support structure for an escalator or a moving walk comprising:

a truss support having lateral slots formed therein;

an intermediate vertical member having a first end and a second end, the intermediate vertical member being connected at the first end to the truss support through the lateral slots of the truss support and to a building support at the second end such that once a predetermined coefficient of friction between the intermediate vertical member and the truss support is overcome, the truss support is free to move laterally with respect to the intermediate vertical member;

wherein the truss support includes a first fixed plate on a bottom side of a bottom portion of the truss support and a second fixed plate on a top side of the bottom portion, wherein a first sliding plate is attached to the first fixed plate and is connected to the intermediate vertical member, and wherein a second sliding plate is attached to the second fixed plate and is connected to the intermediate vertical member; and side posts arranged at each lateral end of the truss support, wherein the side posts bear vertical forces acting on the support structure, and further comprising plate bearings below the side posts to allow lateral movement of the side posts relative to the building support.

2. The support structure according to claim 1 wherein the second end of the intermediate vertical member is connected to the building support between two resilient buffers.

3. The support structure according to claim 1 wherein the second end of the intermediate vertical member is connected to the building support between two angle brackets.

4. The support structure according to claim 1 wherein the first end of the intermediate vertical support member includes a foot attached thereto, the foot being connected to the first sliding plate by connecting screws extending through the first sliding plate and the lateral slots.

5. The support structure according to claim 4 wherein the second sliding plate is connected by the connecting screws.

6. The support structure according to claim 1 wherein the truss support comprises an "I" beam structure.

7. The support structure according to claim 1 wherein the first and second sliding plates are connected by connecting screws.

8. The support structure according to claim 7 wherein the connecting screws are screwed to a tightening torque of between about 40 Nm and 80 Nm.

9. The support structure according to claim 1 wherein the sliding plates are made of stainless steel, brass, copper, PTFE coated sheet materials, or white metal.

10. A support structure for an escalator or a moving walk comprising:

a truss support having lateral slots formed therein;

at least one pair of sliding plates, the sliding plates having holes formed therein;

an intermediate vertical member having a first end and a second end, the first end including a foot and the second end being connected to a building support; and at least two connecting screws wherein the intermediate vertical member foot is connected to the sliding plates by the connecting screws through the holes, and connected to the truss support through the lateral slots and wherein the connecting screws are connected such that once a predetermined coefficient of friction is overcome, the truss support is free to move laterally with respect to the intermediate vertical member, and wherein the second end of the intermediate vertical member is connected to the building support between two resilient buffers.

11. The support structure according to claim 10 wherein the resilient buffers are made of rubber.

12. The support structure according to claim 10 wherein the second end of the intermediate vertical member is connected to the building support between two angle brackets.

13. The support structure according to claim 10 wherein the connecting screws are screwed to a tightening torque of between about 40 Nm and 80 Nm.

14. The support structure according to claim 10 wherein the sliding plates are made of stainless steel, brass, copper, PTFE coated sheet materials, or white metal.

15. A support structure for an escalator or a moving walk comprising:

a truss support having lateral slots formed therein;

at least one pair of sliding plates, the sliding plates having holes formed therein;

an intermediate vertical member having a first end and a second end, the first end including a foot and the second end being connected to a building support between two resilient buffers and two angle brackets; and at least two connecting screws wherein the intermediate vertical member foot is connected to the sliding plates by the connecting screws through the holes, and connected to the truss support through the lateral slots and wherein the connecting screws are connected such that once a predetermined coefficient of friction is overcome, the truss support is free to move laterally with respect to the intermediate vertical member.

* * * * *